United States Patent [19]

Kemp, Jr. et al.

[11] 4,142,689

[45] Mar. 6, 1979

[54] SHREDDER-FEED DEVICE

[76] Inventors: Dennis E. Kemp, Jr., P.O. Box 167, South Orange, N.J. 07079; Albert E. Morin, 150 Medford St., Warwick, R.I. 02889

[21] Appl. No.: 836,297

[22] Filed: Sep. 26, 1977

[51] Int. Cl.[2] ..... B02C 18/24; B02C 19/22

[52] U.S. Cl. ..... 241/247; 198/666; 198/670; 241/260.1

[58] Field of Search ..... 241/247, 260.1; 198/662, 664, 666, 669, 670

[56] References Cited

U.S. PATENT DOCUMENTS

| | | | |
|---|---|---|---|
| 287,010 | 10/1883 | Desgoffe et al. | 241/247 |
| 695,878 | 3/1902 | Geiger et al. | 241/260.1 X |
| 1,780,067 | 10/1930 | Cox | 241/247 X |
| 3,072,243 | 1/1963 | Davis | 198/666 |
| 3,730,332 | 5/1973 | Benzon et al. | 198/666 |

*Primary Examiner*—Howard N. Goldberg
*Attorney, Agent, or Firm*—Mark T. Basseches; Paula T. Basseches

[57] ABSTRACT

The present invention is directed to a jam resistant shredder-feed device for advancing and comminuting elongate materials, such as copper wire scrap, plastic mold runners and the like. In accordance with the invention, an auger assembly is rotated within a cylindrical housing, the auger assembly advancing the materials to be comminuted toward a stationary knife or breaker. The device is characterized by the employment of one or more idler auger sections adjacent the stationary knife, the upstream and downstream ends of the idler section or sections themselves defining knives, as does the downstream end of the feed auger, the respective knife portions being preferably spaced apart in a longitudinal direction by distances slightly greater than the average thickness of materials to be processed.

6 Claims, 7 Drawing Figures

SHREDDER-FEED DEVICE

BACKGROUND OF THE INVENTION

Field of the Invention

The present invention is in the field of self-feeding shredding devices especially intended for treatment of elongated scrap materials, such as copper wire, mold runners, etc. Such reclaimable materials, for further processing, typically must be severed into discrete lengths within a predetermined size range.

While shredder devices heretofore known are effective to comminute certain types of materials, the processing of elongate materials presents substantial problems. This is especially so where it is desired simultaneously to sever the materials into short lengths and feed the material.

It is well known, for instance, that elongate materials, especially ductile materials such as copper wire, cannot be fed in an auger type conveyor since they tend to become wrapped about the auger flutes.

Additionally, in the processing of scrap of the type described with extant shredder units, the tendency to stall or jam in the shredder has been great, requiring frequent down time to clear the resultant jams. Also, conventional shredders operate at efficiencies proportional to the sharpness of the knives, necessitating frequent sharpening to maintain satisfactory performance. As an alternate means of avoiding jams, resort has been made to extremely heavy duty, high powered devices having a capacity well in excess of the power necessary for ordinary processing but keyed instead to the occasionally arising jam condition.

A common defect in devices heretofore used lies in their cutting of the scrap by the exertion of shearing forces between closely spaced stationary and rotating knives. If scrap is caught in the nip between relatively moving parts disposed adjacent the rotating axis of the moving cutting member, the shearing apparatus will usually be effective to sever the scrap and avoid a jam. If, however, scrap elements are caught between the moving and stationary knives at a position remote from the shaft axis, far greater forces must be exerted to achieve shearing.

SUMMARY OF THE INVENTION

The present invention may be summarized as directed to an anti-jam shredder-feed device especially adapted for treatment of elongate scrap material. The device of the present invention is characterized by a cutting action which may be referred to as tensile cutting, wherein elongated scrap is drawn or pulled across cutting edges, enabling a cut to be progressively made, whereby the power requirements for cutting scrap of a predetermined size are substantially less than apparatuses which dependent solely or principally upon shearing action.

The apparatus is further characterized by an anti-jam feature which tends, in the event that a particularly resistant increment or increments of scrap are positioned in a manner which might otherwise cause a jam, to relieve the jam by exerting on the scrap, forces which would tend to remove the scrap from its wedged position and by acting on the scrap engaging elements in a manner to release them from the scrap.

Accordingly, it is an object of the invention to provide an anti-jam shredder-feed device especially adapted for comminuting and simultaneously feeding elongate materials such as wire scrap.

A further object of the invention is the provision of a device of the type described, the power requirements and structural strength of which, by virtue of the novel design, need not be as great as comparable characteristics of conventional shredders of equal capacity.

A further object of the invention is the provision of a device of the type described where a major part of the cutting action is a tensile cutting action as opposed to the more conventional shearing action.

Still a further object of the invention is the provision of a device of the type described which simultaneously feeds the articles being comminuted such that materials to be processed may be deposited at an upstream in-feed station and are automatically severed and delivered at a downstream out-feed station.

Still a further object of the invention is the provision of a device of the type described which includes as its basic elements a feed auger operating within a housing, a knife member downstream of the auger, and an idler auger section interposed between the knife and the feed auger, the idler auger section including at its upstream and downstream ends, knives cooperating respectively with the downstream knife on the feed auger and the stationary knife whereby, if a jam occurs either at the interface between the feed and idler augers or at the interface between the knife and idler auger, there will be a reduced tendency toward jamming or stalling since stalling cannot occur unless the idler auger is precluded from moving relative to the stationary knife and also the feed auger is prevented from rotating relative to the idler auger.

Still a further object of the invention is the provision of a device of the type described wherein the pitch of the idler auger is opposed to the pitch of the feed auger whereby, in the event of a scrap accumulation between the noted augers, the force of additional material moving downstream will act against and relatively rotate the idler auger in a direction opposite to the direction of rotation of the feed auger, relieving the shear forces exerted against the accumulated scrap, and thus averting a jam.

Still a further object of the invention is the provision of a device of the type described which includes still a further idler auger immediately downstream of the stationary knife, whereby there is defined a shredding sequence comprising a feed auger section, a first idler auger section, stationary knife section and a second idler auger section, such sequence being repeatable within a single device, if necessary, whereby the materials to be processed must travel through a plurality of sections of the type described.

To attain these objects and such further objects as may appear herein or be hereinafter pointed out, reference is made to the accompanying drawings, forming a part hereof, in which.

Figures 1, 4, 5, 6:
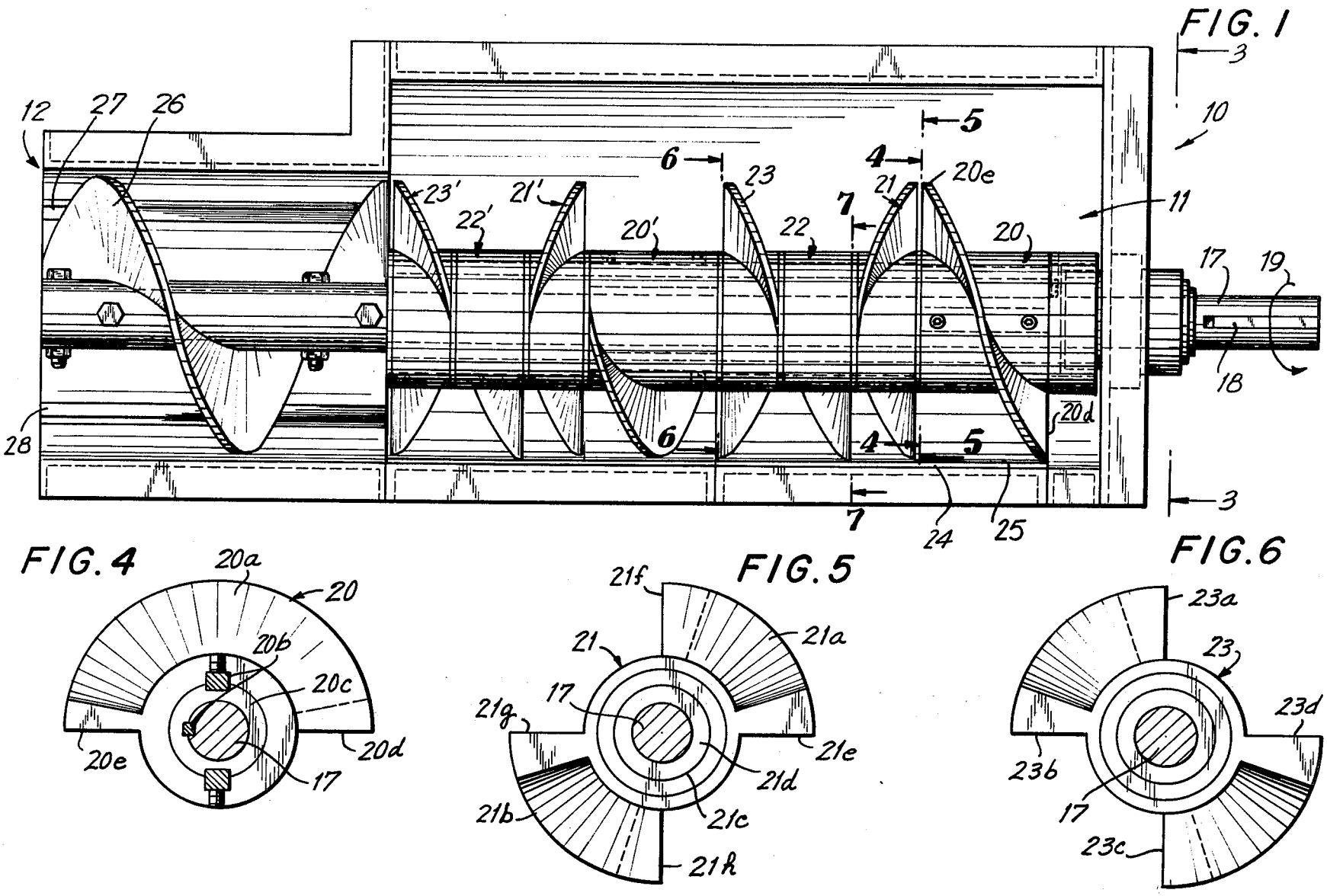
FIG. 1 is a top plan view of an apparatus of the type described, upper portions of the housing having been broken away to facilitate an understanding of the operation of the device.

FIGS. 4, 5, 6, and 7 are sectional views of the operative elements of the apparatus taken, respectively, on the line 4—4, 5—5, 6—6 and 7—7 of FIG. 1.

Figure 2:
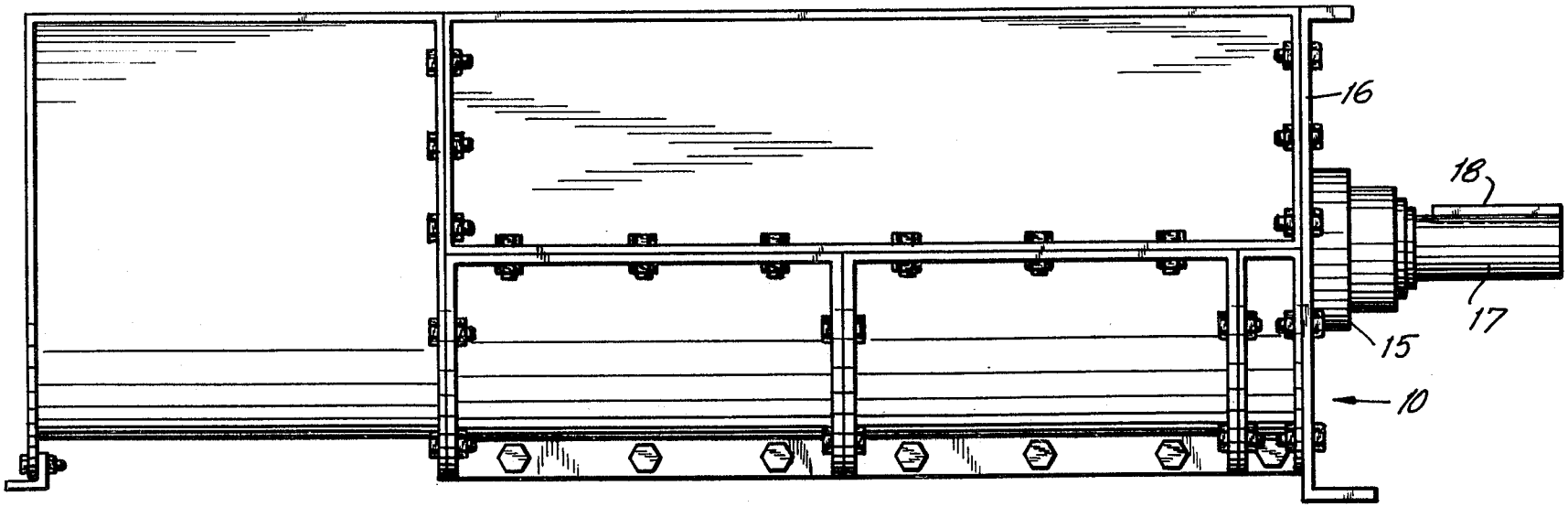
FIG. 2 is a side elevational view of the apparatus in accordance with the invention.
Figure 3:
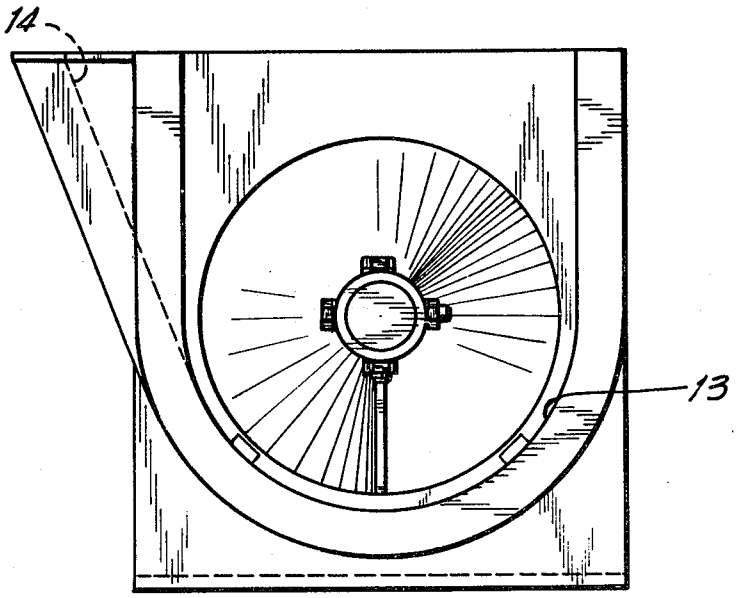
FIG. 3 is an end elevational view taken in the direction of the line 3—3 of FIG. 1.

Referring now to the drawings, there is shown in FIGS. 1 and 2 a device in accordance with the invention including a frame member 10 preferably comprised of a plurality of bolted-together sections, the sections together defining an extrance or in-feed end 11 and an exit or out-feed end 12. The sections together define a housing, the under surface or floor 13 of which, as best seen in FIG. 3, is semi-cylindrical. The housing 10 may include an inclined lateral hopper or feed chute area 14 which may be progressively or bulk charged and which guides scrap material into the interior of the housing and into contact with the operative members hereinafter to be described. The apparatus may be provided with a cover (not shown) if the materials which are to be shredded are sufficiently brittle or resilient as possibly to fly clear of the processing mechanism.

A heavy duty flanged roller bearing 15 is fixed to end wall 16 of the housing 10, the bearing rotatably carrying shaft 17. The shaft 17 is connected to the output of a speed reducer member (not shown) as by key member 18. The speed reducer functions to rotate the shaft 17 at a desired speed and within selected power ranges, dependent upon such factors as the capacity of the device, the materials to be processed, etc.

By way of example and without limitation, a shredder device calculated to process scrap copper wire up to ¾" combined insulation and copper by severing the same into increments averaging 2" in length may desirably employ a 50 horsepower motor operating through a 35 to 1 ratio speed reducer so as to drive the shaft 17 at an average rate (unloaded) of about 50 rpm. Such a unit (preferably employing six processing sequences as hereinafter defined) will process about 12,000 to 15,000 pounds of such scrap per hour.

It will be understood that the shaft 17 is rotated in the illustrated embodiments in the direction of the arrow 19 — see FIG. 1.

The housing 10 incorporates one or more processing sequences, the term "processing sequence" as used herein being employed to define a plurality of auger sections which cooperate simultaneously to feed and sever discrete lengths from elongated scrap material deposited at the in-feed station 11. More particularly, the auger sections constituting a processing sequence, as will be more specifically described hereinafter, include a drive section or segment 20, a first idler section 21, a static or knife section 22, and a second idler section 23.

Referring more particularly to the configurations of the individual segments or sections above generally referred to, the drive or feed section 20 shown in FIG. 4 constitutes half a flight of an auger section, the lead surface **20*a* of which is pitched so as to feed material from right to left when viewed in the orientation of FIG. 1. The drive section 20 is keyed to rotate with the shaft 17, as by spline members 20*b* which span the interface between the collar 20*c* and the shaft 17. The lead and trailing edges 20*d* and 20*e*, respectively, of the drive segment 20** are sharpened and define knife portions.

Auger section 21 comprises an idler section, so named since the same is free to rotate relative to the shaft 17. As best seen in FIG. 5, the first idler section 21 comprises an opposed pair of quarter flights **21*a*, 21*b*, the pitch of the flights 21*a* and 21*b* being opposite to the pitch of the feed section 20. The auger section 21 includes an inner diameter portion 21*c* rotatably mounted on an enlarged bearing member 21*d* secured to the shaft 17. The edge portions 21*e*, 21*f*, 21*g*, 21*h* of the auger section 21** are sharpened to define knife portions.

Figure 7:
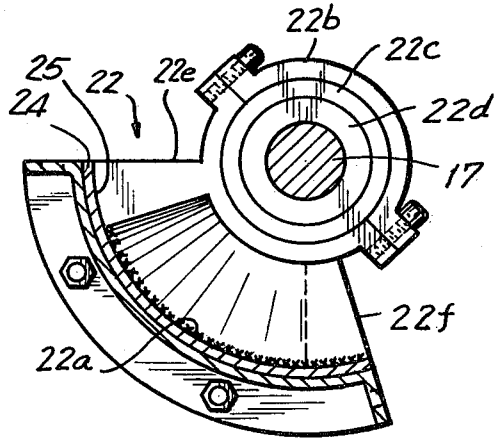

The auger section 22, which is best shown in FIG. 7, constitutes a static section. The section 22, which constitutes essentially a quarter flight of auger pitched in the opposite direction from the drive segment 20, is welded at its periphery **22*a* to a reinforcing guide plate 24, said guide plate 24 being, in turn, fastened as by welding to the housing 10. The guide plate 24**, which preferably extends the entire length of the processing area, constitutes an elongate arcuate piece extending along the floor of the hopper from a position coincident with the downward projection of the center line of the hopper upwardly along the side of the hopper to approximately a 3 o'clock position.

It will thus be observed that the direction of rotation of the shaft is such as to bring the upper surface of the rotating auger feed sections downwardly toward the upper surface 25 of the guide plate 24, and that any severed material falling against static auger section 22 will be carried forward under gravitational influences. It will be further observed that the reinforced guide plate defines the closest point of approach between the periphery of the augers and the housing, the spacing preferably being greater than the thickness of the material to be processed.

The static auger section or sections 22 define intermediate support for the drive shaft 17. To this end, the static sections include a pillow block assembly **22*b* clampingly supporting outer race 22*c* of a bearing assembly, the inner race 22*d* of which is mounted over the shaft 17. The end surfaces 22*e*, 22*f*** of the static segment define sharpened knife portions.

The section 23 constitutes an idler section which is in all respects identical to the idler section 21 except that the pitch of the section is opposite that of the pitch of section 21. The idler section 23, as shown in FIG. 6, defines knives at its terminal ends **23*a*, 23*b*, 23*c*, 23*d***.

As will be evident from an inspection of FIG. 1, there has heretofore been described a sequence including the feed auger section 20, first idler auger 21, static section 22 and second idler auger 23. The sequence is repeated by the auger sections 20', 21', 22' and 23', the illustrated apparatus thus consisting of two complete sequences.

It will be readily recognized that, depending upon the nature of the material to be processed and the size of the desired end product, one such sequence may suffice or, alternatively, three or more sequences may be provided.

Immediately downstream of the auger section 23' there is provided a delivery auger section 26 functioning to advance the severed increments to the output station 12.

Optionally, two or more breaker bars 27, 28 may be disposed at the periphery of the floor beneath the auger section 26.

The auger sections 20, 21, 22, 23, etc. are separated longitudinally along the axis of the shaft 17 by spacer plates (not shown), the thickness of the plates being calculated to be slightly larger than the average diameter of the material to be processed. Preferably, where it is desired that an apparatus be adaptable to processing various sizes of material, provision is made for axially relatively shifting the auger sections and substituting spacer plates of varying size, thus to vary the spacing of the knife portions of adjacent auger sections.

OPERATION

The operation of the device will be apparent from the preceding description.

The device is activated and the shaft caused to rotate in the direction of the arrow 19, whereby the sections 20 and 20' and the auger section 26 will be caused to rotate with the shaft. Scrap material may be deposited in the hopper adjacent the in-feed end 11, the material being urged upwardly and longitudinally toward the out-feed end 12 by the action of the auger section 20. Lengths of the scrap will progressively be advanced until they fall into the space between the various adjacent cutting edges.

The principal cutting action may be described as a tensile cutting as opposed to a shear cutting. In order to appreciate the advantages of the invention, it is desirable to compare the shear cutting action of shredder devices heretofore known with the tensile cutting action of the instant device.

In shear cutting, the efficiency of the cutter is predicated upon the sharpness of the knives and the maintenance of minimum clearance between the relatively moving knives. Cutting is effected by applying a shearing or severing force to an article captured between adjacent moving parts, the article, by the impact of the relatively moving parts, being precluded or restrained in its relative movement as respects the knives following initiation of the cut.

In the tensile cutting action in accordance with the present invention, the elongate material tends to wrap about or become clamped between the ends of adjacent relatively moving auger sections whereby lengths of material are captured and caused to be pulled or drawn across the length of the transverse knife sections. The cutting action is principally of a progressive nature, taking place incrementally as the material is drawn across the knives.

Unlike shredders heretofore known, substantial longitudinal clearance is thus permitted to exist between adjacent knife components and the sharpness of the knives, while a desirable characteristic, is not nearly so critical.

The principal cutting action is effected at the interface between the stationary knife portion **22*e* and the knife portions 21*e* and 21*g* of the idler section on the one hand, and between the knife section 20*e* of the drive or feed section and the edges 21*f* and 21*h*** of the idler, on the other.

It will be readily recognized that the idler section 21 can afford no cutting action unless it is caused to rotate. Rotary forces are imparted to the idler sections 21 and 23 by virtue of the accumulation of scrap between the knife portions of the driver and idler sections. Where such scrap accumulates, the idler section 21 is temporarily caused to be a driven section. Lengths of scrap may span the total distance between the drive section, the idler section, and the static section and, indeed, may extend into the area of the second of the downstream idler sections 23 whereby, with continuous rotation of the shaft, the scrap which is thus gripped at spaced points is progressively drawn across the knife surfaces of adjacent knives intermediate the length of the scrap increment with increasing tension, resulting in a slicing or progressive cutting action.

It will thus be observed that by virtue of the progressive cutting action as opposed to the abrupt shearing action of conventional shredders, substantially less rotary force need be exerted than is the case with a shear type cutter.

A further advantage of the present invention lies in its self-clearing action. In conventional shredder structures, should a single, especially resistant increment of material fall between relatively moving parts, a jam will occur, necessitating interruption of the power to the device, and manual clearing of the jam. In the instant device, by virtue of the reverse pitch of the idler auger sections, material being fed in a downstream direction tends, in the event of a partial jam between the idler auger section on the one hand and the static and drive auger sections on the other, to open or separate the knife sections clampingly engaging the jam causing increment.

Specifically, it will be readily apparent that a stalling force will occur if one of two conditions occurs, namely:

a — a single, highly resistant, elongated strand spans the entire gap between a drive auger, e.g. 20, and a static section 22. Where such condition occurs by virtue of the elongate nature of the scrap piece, it is highly likely that the stalling force will be overcome by severing the elongate increment since the very length of the captured piece permits of its being drawn across and consequently cut by one of the knife sections;

b — a first short resistant increment is captured between the driven auger section 20 and idler auger section 21, and a second short resistant scrap increment is caught between the knives of static section 22 and idler auger 21. It will be readily recognized, however, that the likelihood of two such conditions occurring simultaneously is remote.

In the event of a condition as described under b, the device, as briefly noted above, provides a substantial jam clearing effect by virtue of the reverse pitch of the idler auger section 21. Should an increment of scrap, by way of example, be captured between idler auger 21 and a static knife, the downstream moving increments of scrap, acting against the upstream surface of the auger section 21, tend to rotate the auger section in a reverse direction by virtue of its pitch inclination. This counter-rotational force which may, as a practical matter, effect only a few degrees of retro movement of the idler auger, tends to release the captured stalling increment from the nip between adjacent knives, whereby the article is freed for continued downstream movement.

Although some degree of cutting is effected by the trailing idler auger sections 23 and 23', the function of these sections is principally to act as jam clearing members, and also, when a stall is effected between the section 23 and either an adjacent feed or static section, to provide an additional knife surface against which tensile cutting may be effected.

While the movable auger sections, the feed auger sections 20, 20', and idler auger sections 21, 23, 21' and 23', have been described as mounted in fixed axial position along the shaft 17, it has been determined that advantages may result from permitting a limited degree of axial movement of the idler sections. Such movement has been found to provide what may be described as a compound cutting action wherein scrap is simultaneously subjected to a slicing or tensile cutting action as hereinabove described, and also to a simultaneous compressive cutting action.

A further advantage of the instant device over shredder devices heretofore known, especially those employing self-feed elements, lies in the fact that in the instant device the principal cutting action is effected between knife surfaces which have a positive rake or cutting angle as respects each other. In devices heretofore known, which provide combined feeding and cutting action, the cutting is effected between parts having a negative rake and consequent reduced cutting efficiency.

As will be evident from the above, the material, after severing, is progressively advanced in the downstream direction to the delivery auger section 26 and thence to the out-feed station 12.

If it is desired that the original elongated scrap increments be reduced to an especially short length, the apparatus advantageously should include a multiplicity of end-to-end arrayed cutting sequences.

As will be evident to those skilled in the art, numerous variations may be made in the illustrated embodiment of the apparatus in the light of the disclosure herein contained without departing from the spirit of the invention. Accordingly, the invention is to be broadly construed within the scope of the appended claims.

Having thus described the invention and illustrated its use, what is claimed as new and is desired to be secured by Letters Patent is:

1. An anti-jam shredder-feed device for feeding and comminuting elongate materials comprising, in combination, a housing having a generally cylindrical bottom including an upstream in-feed end and a downstream discharge end, a drive shaft extending coaxially of and adapted to rotate within said housing, a drive auger section in said housing keyed to said shaft for rotation therewith, having a pitch inclination sloped to advance materials in a downstream direction from said in-feed toward said out-feed end, a stationary knife member in downstream spaced relation to said drive section extending transversely between said housing and said shaft, an idler auger section mounted for rotation relative to said shaft between said knife and said drive section, the adjacent end portions of said auger sections defining transversely extending knife portions positioned to pass in proximate spaced relation upon relative rotation of said sections, the downstream end of said idler auger section defining a further knife portion movable in a path adjacent said stationary knife member responsive to rotary movement of said idler section.

2. A device in accordance with claim 1 wherein said idler section is pitched in a direction opposite the pitch of said drive section.

3. A device in accordance with claim 2 wherein said stationary knife member comprises the upstream end of an auger section pitched in a direction opposite the direction of said drive auger section.

4. A device in accordance with claim 3 and including a second idler auger section downstream of said knife mounted for rotation relative to said shaft, said second idler section being pitched in the direction of said drive auger section and including transversely extending knife portions at its upstream and downstream end portions.

5. A device in accordance with claim 4 and including a further said drive auger section downstream of said second idler auger section, at least the upstream end of said second drive auger section defining a transversely extending knife portion positioned to pass in proximate spaced relation to the downstream knife portion of said second idler auger.

6. A device in accordance with claim 5 wherein said drive auger section comprises half of an auger flight and said idler auger sections each comprises an opposed pair of quarter auger flights.

* * * * *